US008469511B2

(12) United States Patent
Miller et al.

(10) Patent No.: US 8,469,511 B2
(45) Date of Patent: Jun. 25, 2013

(54) EYEGLASSES HOLDER

(76) Inventors: Jessica Miller, Fort Worth, TX (US); Susan Miller, Forth Worth, TX (US)

( * ) Notice: Subject to any disclaimer, the term of this patent is extended or adjusted under 35 U.S.C. 154(b) by 0 days.

(21) Appl. No.: 13/250,881

(22) Filed: Sep. 30, 2011

(65) Prior Publication Data

US 2012/0081656 A1 Apr. 5, 2012

Related U.S. Application Data

(60) Provisional application No. 61/388,269, filed on Sep. 30, 2010.

(51) Int. Cl.
*G02C 3/00* (2006.01)
*A44B 6/00* (2006.01)

(52) U.S. Cl.
USPC ..... 351/155; 351/156; 351/157; 351/158; 24/3.3

(58) Field of Classification Search
USPC ..... 351/158; 24/3.1, 3.3; 248/309.1, 248/309.4, 902; 206/5
See application file for complete search history.

(56) References Cited

U.S. PATENT DOCUMENTS

| | | | | |
|---|---|---|---|---|
| D58,645 | S | 8/1921 | Van Bloem | |
| 2,770,168 | A * | 11/1956 | Tesauro | 351/57 |
| 4,949,432 | A * | 8/1990 | Wisniewski | 24/3.3 |
| D312,773 | S | 12/1990 | Salinas | |
| D328,086 | S | 7/1992 | Tallmadge | |
| 5,235,727 | A | 8/1993 | McCloskey | |
| 6,367,126 | B1 | 4/2002 | Rivkin | |
| 6,382,482 | B1 * | 5/2002 | Chao | 224/312 |
| 6,568,805 | B1 | 5/2003 | Dietz | |
| 7,494,217 | B2 | 2/2009 | Jongebloed, Jr. | |
| 7,553,018 | B1 | 6/2009 | Riazi | |
| 7,677,722 | B1 | 3/2010 | Mednick et al. | |
| 2005/0146676 | A1 * | 7/2005 | Silvestro | 351/158 |
| 2007/0006425 | A1 | 1/2007 | Woodbury | |
| 2010/0110366 | A1 | 5/2010 | Shapiro | |

* cited by examiner

*Primary Examiner* — Scott J Sugarman
*Assistant Examiner* — Robert E Tallman

(57) ABSTRACT

An eyeglasses holder comprising an arm and a hollow body. The arm is connected to the hollow body through a bridge at the top end of the arm forming a groove between the arm and hollow body. According to one embodiment, a plurality of planar protrusions extends radially from the inner surface of the hollow body toward the center of the hollow body to grip and secure the eyeglasses during transport. An alternative embodiment comprises a magnetic member contained by the hollow body that exerts a magnetic force on a pair of eyeglasses either directly or via an attached metallic strip.

1 Claim, 13 Drawing Sheets

EYEGLASSES HOLDER

CROSS-REFERENCES TO RELATED APPLICATIONS

This original nonprovisional application claims benefit of and priority to U.S. Provisional Application Ser. No. 61/388,269, filed Sep. 30, 2010 and entitled "Eyeglasses Holder," and which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates generally to eyeglass holders and, in particular, to a lightweight, unobtrusive holder for holding and storing spectacles or eyeglasses while simultaneously providing protection for the eyeglasses when not in use by a user.

2. Description of the Related Art

According to the Vision Council of America, approximately seventy-five percent (75%) of adults use some sort of vision correction. About sixty-four percent (64%) of adults wear eyeglasses, and about eleven percent (11%) wear contact lenses, either exclusively, or with glasses. Over half of all women and about forty-two percent (42%) of men wear glasses. Fourteen percent (14%) of Americans use eyeglasses purchased from a drugstore. Approximately eight-five percent (85%) of the American population also wear sunglasses. Sunglasses can either be prescription or used recreationally to protect the eyes from damage from the sun.

Eyeglasses, including prescription and/or sunglasses, generally are comprised of a frame bearing lenses worn in front of the eyes. Temple bars hingedly attached to the front of the frame and extend backward therefrom. A bridge containing nose pads connects the two lenses. The temple bars and nose pads support the glasses on the face of the user.

As technology advances, so does the cost of prescription eyewear and sunglasses. Consequently, many individuals will place their eyewear—which can be a substantial personal investment—in portable cases to prevent them from getting damaged. However, though the protective cases may offer some protection for the glasses, this does not necessarily prevent the cases containing the glasses from getting lost or misplaced.

Often times, users find themselves without a protective case. For example, when retiring to bed, the user simply places his or her eyeglasses on the nightstand. Alternatively, the user may get tired of wearing the eyeglasses and remove them temporarily increasing the risk of misplacing them or forgetting where the eyeglasses were placed. Still others may simply place their eyeglasses in either their shirt breast pocket or pants pocket. However, placing eyeglasses alone in a shirt pocket runs the risk that the glasses may slip out and become damaged when the user bends over. If placed in pants pockets, there is a risk that the glasses will be damaged when the user sits down or otherwise bends at the waist.

To solve these problems, several products have emerged. For example, one product has incorporated a carabiner, or D-clip, into the frame of the glasses in order to attach the frame to the user's clothing, belt loop, backpack, purse or other carried article (U.S. Patent Application Publication No. US 2010/0110366). However, this product does not offer much protection as the user's movement may cause the glasses to bounce back and forth and damage the glasses. Still another product attaches a clip to the temple portion of an eyeglass frame so that the eyeglasses may be clipped or attached to the user's clothes (U.S. Pat. No. 7,677,722). Various other clips have also been created in the quest for protection of eyewear including U.S. Pat. No. 5,235,727, US 2007/0006425, U.S. Pat. No. Des. 328,086, U.S. Pat. No. 5,235,727, and U.S. Pat. No. Des. 312,773.

While the products described above aid in minimizing the loss of glasses by the user by attaching the eyeglasses to the user's clothing, these products require that the clips be somehow attached to the frame of the eyeglasses during use. This takes away from the inherent aesthetic appeal of the eyeglasses. There also still remains a need to simultaneously provide protection of the eyewear when it is attached to the user's clothing as the clips described above afford minimal protection of eyeglasses. Additionally, the required attachment of the clips to the eyeglasses adds weight and makes for heavier eyeglasses which become uncomfortable after an extended period of use by the user, especially on the nose. The present invention corrects the shortcomings of the currently available eyeglass clips.

In the present invention, not only do the eyeglasses remain with the user by attaching to an article of clothing (e.g., shirt pocket or shirt collar), but the present invention also provides protection of the eyewear. The present invention also serves as a constant reminder to the user of security of a large personal investment, i.e., the user's eyewear. A user should be able to carry his or her eyewear with him or her in a stylish and unobtrusive manner while simultaneously protect the eyewear from becoming lost or damaged. Accordingly, there is a need for a simple to use, lightweight, unobtrusive and convenient holder for securing, transporting and protecting eyeglasses.

BRIEF SUMMARY OF THE INVENTION

The present invention provides for a holder for a user's eyeglasses. The invention comprises an arm having a top end and a bottom end and a hollow cylindrical body having a top and bottom. A bridge connecting the top end of the arm to the top end of the hollow cylindrical body. The arm is ergonomically shaped on one side and flat on the other. The arm is approximately two and a half times the length of the hollow cylindrical body. A groove is formed within the area defined by the arm, the hollow cylindrical body, and the bridge. In use, portions of articles of clothing will fit inside this groove such that the holder is securely attached to the article of clothing or a portion thereof.

The hollow cylindrical body contains the plurality of planar protrusions along the inside surface of the hollow cylindrical body. The plurality of planar protrusions extends from the top end of the inside surface of the hollow cylindrical body down to the bottom end of the inside surface of the hollow cylindrical body. The ends of the plurality of planar protrusions extend from the inside surface of the hollow cylindrical body toward the center of the hollow cylindrical body defining an annularly shaped area. The hollow cylindrical body may accommodate various sizes of eyewear ranging from small frame glasses to large sunglasses.

The plurality of planar protrusions grips the lens and frame of the eyeglasses to secure and hold the eyeglasses in place within the hollow cylindrical body without scratching or otherwise damaging the glasses. The plurality of planar protrusions further prevents slippage of the glasses. In an alternative embodiment, the planar protrusions may be a plurality of fingers.

In an alternative embodiment, the hollow cylindrical body is detachably connected to the bridge and arm via an annularly-shaped clip. The clip engages around a portion of the hollow cylindrical body sufficient to firmly secure the hollow cylindrical body in a fixed position substantially parallel to the arm. The length of the annularly-shaped clip may vary and can extend approximately half the length of the arm. The length of the hollow cylindrical body may vary and can extend approximately ¾ of the length of the arm. A projecting contact clip extends outward from the left side surface of the lower portion of the arm relative to the bridge.

The length of the hollow cylindrical body extends a length sufficient to make contact with the projecting contact clip. The projecting contact clip protrudes from the left side surface of the lower portion of the arm and biases towards the hollow cylindrical body. An article of clothing or a portion thereof is held secure between the hollow cylindrical body and the projecting contact clip. The present invention may be made of rubber or silicon or other similarly resilient material which does not scratch or otherwise damage the eyeglasses when placed in contact therewith.

In yet another embodiment of the present invention, the hollow body comprises a magnetic member that is attracted to the metallic frame of a pair of eyeglasses. Alternative, a metallic strip may be adhered to a pair of non-metallic eyeglasses to provide the desired magnetic attraction.

It is an object of the present invention to provide a lightweight, convenient and unobtrusive eyeglasses holder that protects the glasses from being damaged.

It is a further object of the present invention to provide convenient storage on the user's person which prevents the loss of glasses.

It is still a further object of the present invention to provide a trendy and stylish holder for eyeglass wearers. The present invention may also be decorated such as with initials, charms, logo or other similar marking.

The present invention can easily be carried by the user on his or her person. If the need arises to remove the user's eyeglasses, the user may use the present invention in order to secure the user's eyeglasses to his or her person as well as prevent any damage to the glasses.

The design illustrated on the figures below is merely for illustrative purposes and not for limitation purposes.

DETAILED DESCRIPTION OF THE INVENTION

Figure 1:
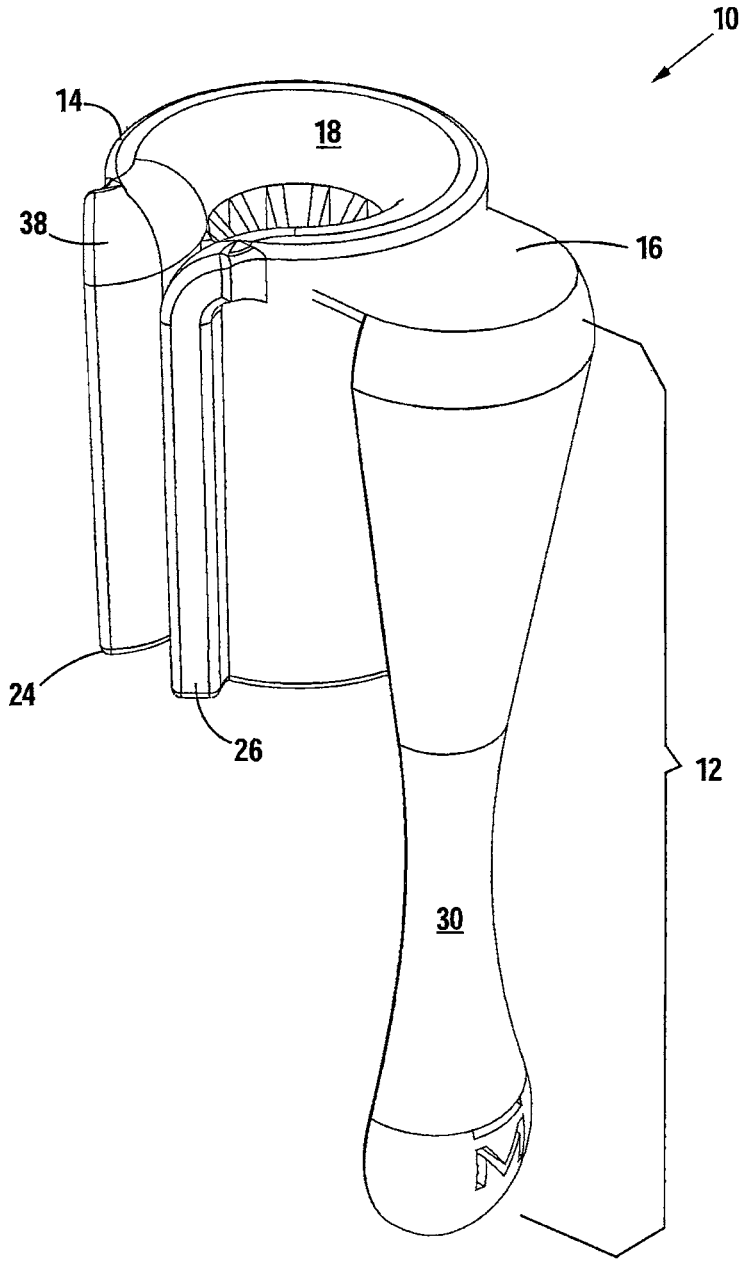
FIG. 1 shows an isometric front perspective view of the present invention.

Referring to FIG. 1, an eyeglass holder 10 is comprised of an arm 12 having a top end and a bottom end and a hollow cylindrical body 14. Bridge 16 connects the top end of arm 12 to the top of hollow cylindrical body 14. Arm 12 is ergonomically shaped on right side surface 30 and flat on left side surface 32 (not shown).

Figure 2:
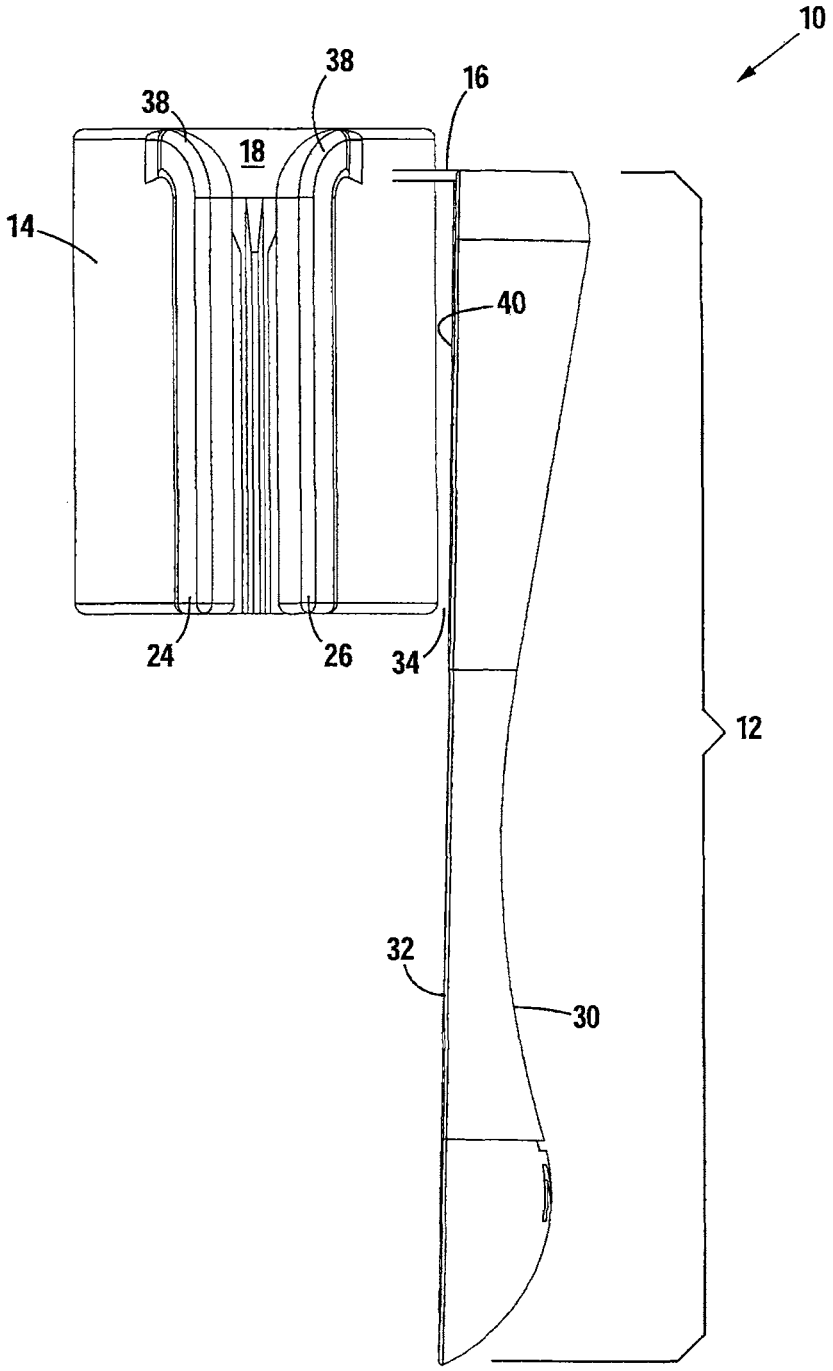
FIG. 2 depicts a front elevated view of the present invention.
Figure 3:
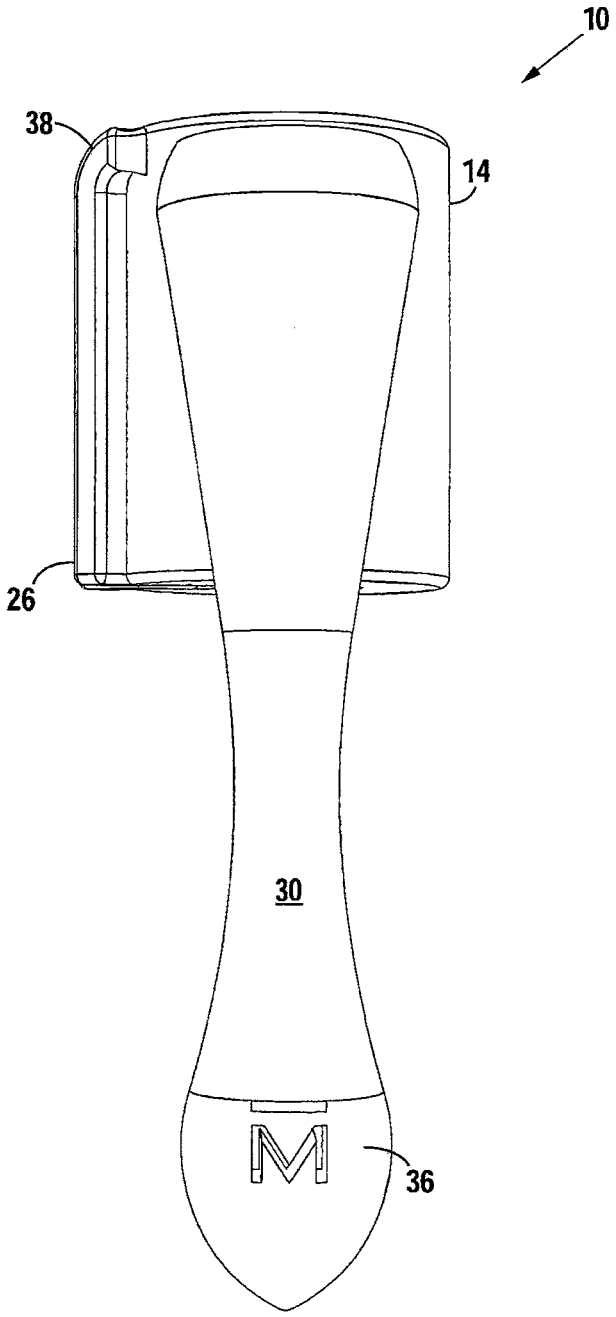
FIG. 3 shows an elevated right side view of the present invention.
Figure 4:
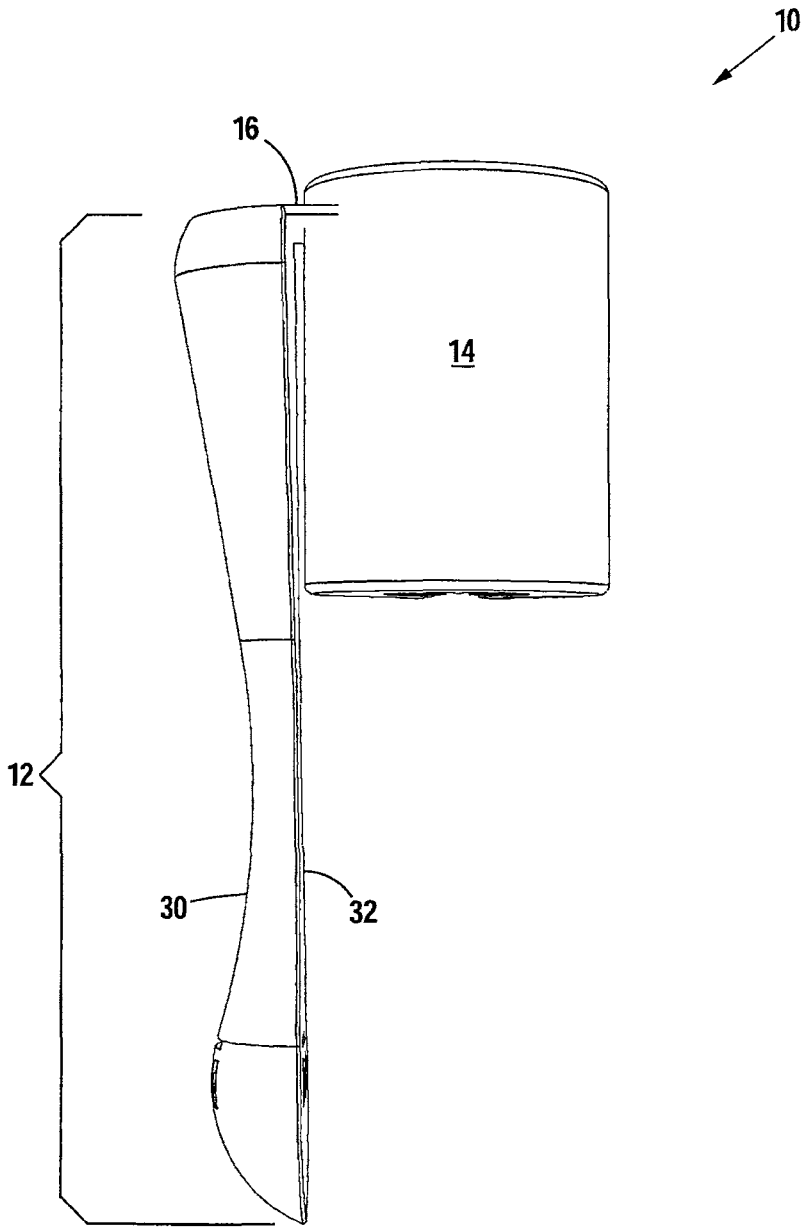
FIG. 4 shows a back elevated view of the present invention.
Figure 6:
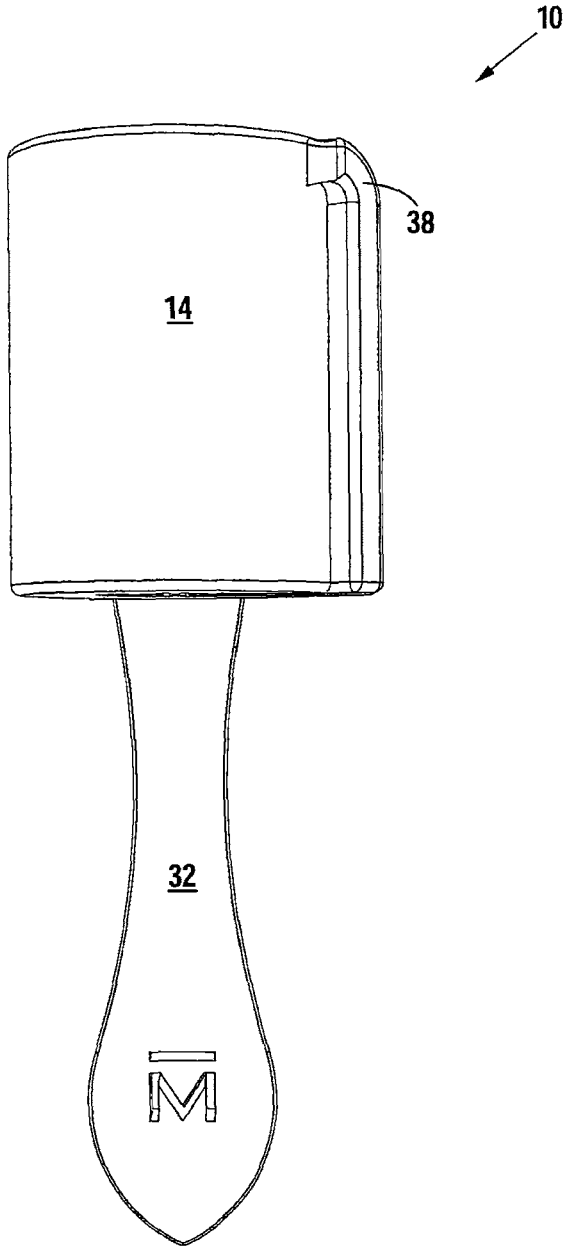
FIG. 6 shows a left elevated side view of the present invention.

Referring to FIGS. 2, 3 and 4, arm 12 is approximately two and a half times the length of hollow cylindrical body 14. A groove 34 for receiving an article of clothing or a portion thereof is formed within the area defined by top inside surface 40 of arm 12, hollow cylindrical body 14 and bridge 16. In an alternative embodiment, the present invention may also be decorated such as with initials, charms, logos or other similar marking, as shown by logo 36 in FIG. 3 (see also FIG. 6).

In an alternative embodiment, bottom end of hollow cylindrical body 14 is angled approximately 45° relative to right side surface 30 of arm 12 such that groove 34 is wider between the top of hollow cylindrical body 14 and arm 12 and more narrow at bottom end of hollow cylindrical body 14 and arm 12. The bottom end of hollow cylindrical body 14 biases toward arm 12. Sufficient human force is required to pull the bottom end of hollow cylindrical body 14 away from arm 12 such that a portion of an article of clothing, such as a shirt neck (not shown), can be slid into and gripped within groove 34. Releasing hollow cylindrical body 14 results in hollow cylindrical body 14 biasing toward arm 12, the result of which effectively fastens the present invention to an article of clothing or a portion thereof.

Figure 5:
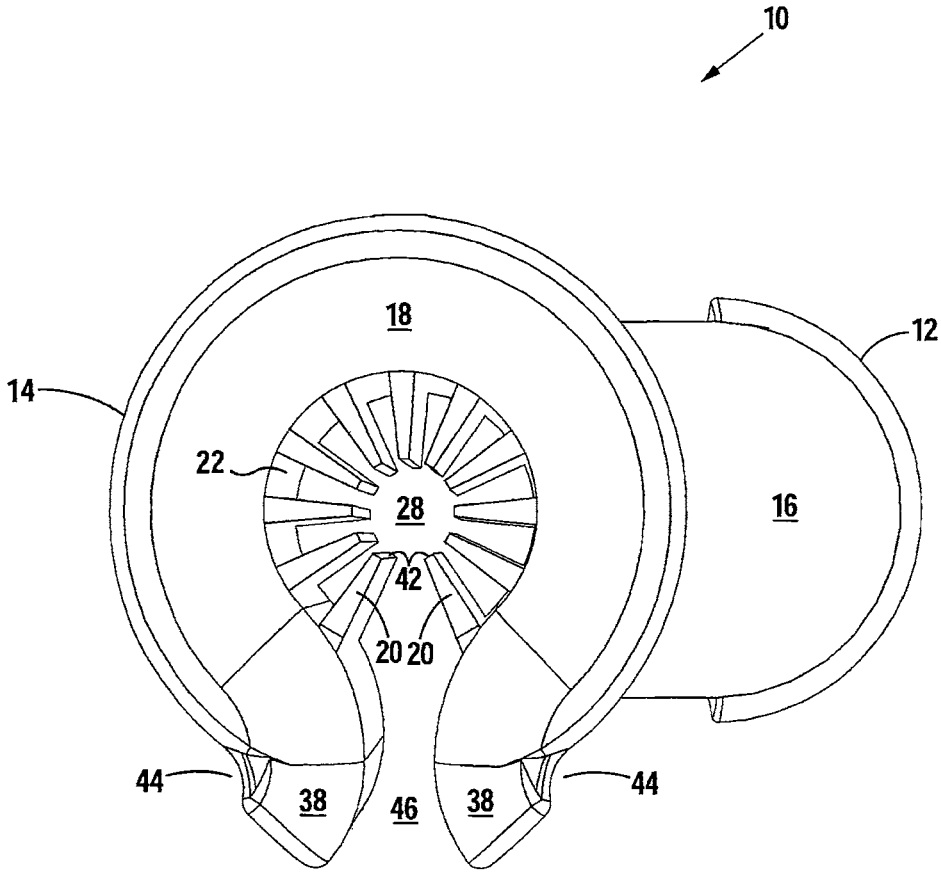
FIG. 5 shows a top view of the present invention.

Referring now to FIG. 5, a plurality of planar protrusions 20 along inside surface 22 of hollow cylindrical body 14 extends from the top end of inside surface 22 of hollow cylindrical body 14 down to the bottom end of inside surface 22 of hollow cylindrical body 14 (see also FIG. 2). Tips 42 of each of the plurality of planar protrusions 20 extend from inside surface 22 of hollow cylindrical body 14 toward the center of hollow cylindrical body 14 defining an annularly shaped area 28. Funnel 18 guides a pair of eyeglasses (not shown) into annular area 28 of hollow cylindrical body 14 as the user places the eyeglasses into eyeglass holder 10 for storage.

Figure 7:
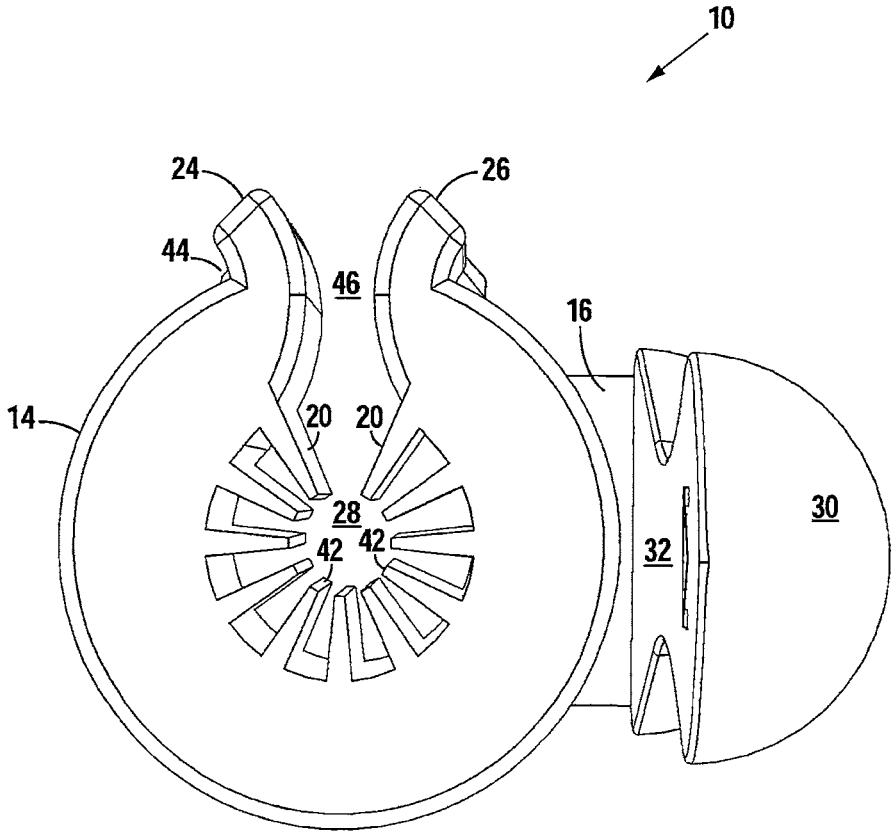
FIG. 7 shows a bottom view of the present invention.

Referring to FIGS. 5 and 7, a portion of hollow cylindrical body 14 opens to form arcuately oriented shoulders 38 creating channel 46 therebetween allowing the present invention to accommodate various sizes of eyewear ranging from small frame glasses to large sunglasses where the lenses and portions of the frame of larger framed eyewear may extend into channel 46. Channel 46 extends from arcuately oriented shoulders 38 down to flanges 24 and 26 on the lower end of hollow cylindrical body 14. Recesses 44 on either side of arcuately oriented shoulders 38 provide a natural resting place for and accommodate the temple bars of the eyeglasses (not shown) in either a frontward position (with the front of the lenses of the eyeglasses facing away from the user) or in a backward position (with the front of the lenses of the eyeglasses facing towards the user).

Figure 8:
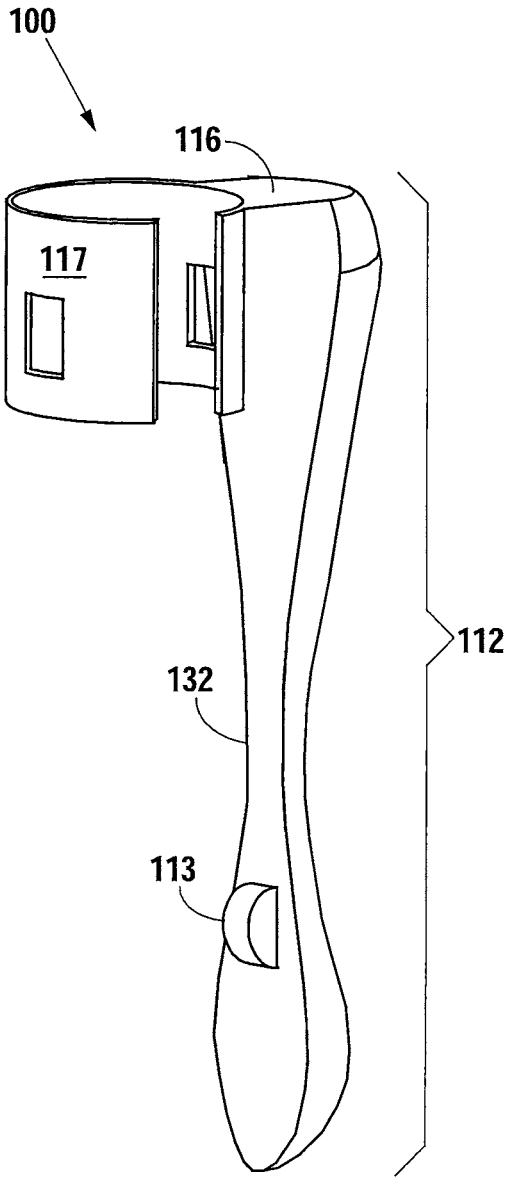
FIG. 8 shows an isometric left side perspective view of an alternative embodiment of the present invention.
Figure 9:
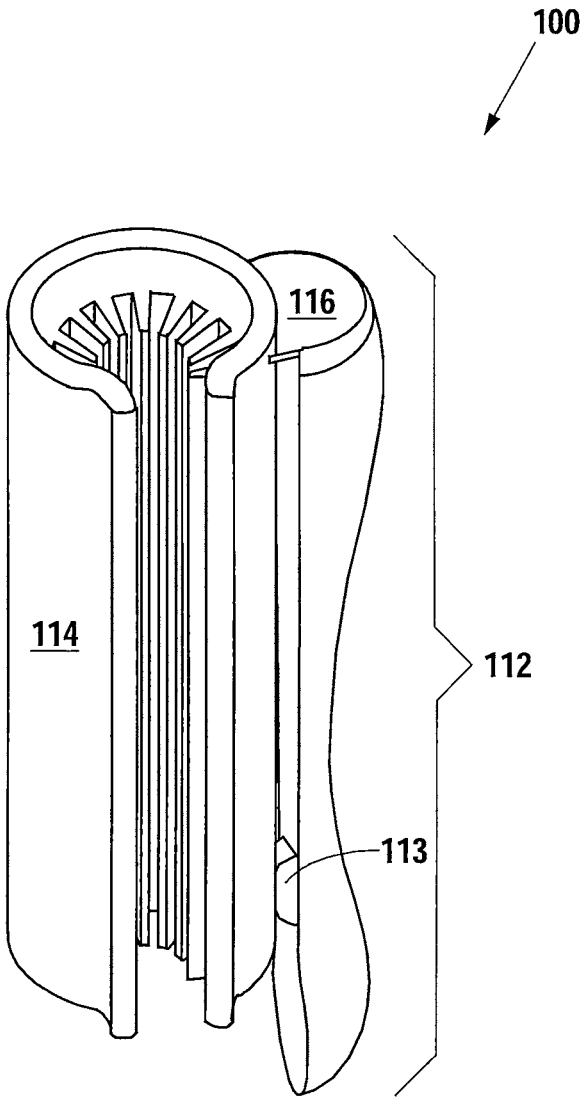
FIG. 9 depicts an isometric front side perspective view of an alternative embodiment of the present invention.

Referring now to FIGS. 8 and 9, in an alternative embodiment 100, hollow cylindrical body 114 is detachably connected to bridge 116 and arm 112 via annularly-shaped clip 117. Clip 117 engages around a portion of hollow cylindrical body 114 sufficient to firmly secure hollow cylindrical body 114 in a fixed position substantially parallel to arm 112. The length of annularly-shaped clip 117 may vary and can extend approximately half the length of arm 112. Projecting contact clip 113 extends outward from left side surface 132 of the lower portion of arm 112 relative to bridge 116.

Referring now to FIG. 9, the length of hollow cylindrical body 114 extends a length sufficient to make contact with projecting contact clip 113. Projecting contact clip 113 protrudes from left side surface 132 of the lower portion of arm 112 and biases towards hollow cylindrical body 114. An article of clothing or a portion thereof (not shown) is held secure between hollow cylindrical body 114 and projecting contact clip 113.

The present invention may be made of rubber or silicon or other similarly resilient material that is not conducive to scratching or otherwise damaging when placed in contact with the eyeglasses. Additionally, if the present invention is dropped, there is a reduced risk that the present invention or the eyeglasses would be damaged.

In using the present invention, the user attaches the present invention to an article of clothing or a portion thereof. By way of example, the user places the neck portion of a shirt within groove 34 (see FIGS. 2 and 4) to secure the present invention thereto. The biasing of hollow cylindrical body 14 toward arm 12 sufficiently grips and secures the present invention in place. The user removes the user's eyeglasses or sunglasses and configures the eyewear into a folded configuration (not shown). The user places the eyewear in the folded configuration into the top portion of hollow cylindrical body 14 using funnel 18 as a guide to guide the eyewear in place within area 28 of hollow cylindrical body 14.

Referring to FIG. 5, as the eyewear enters hollow cylindrical body 14, plurality of planar protrusions 20 grips the lens and frame of the eyeglasses (not shown) to secure and hold the eyeglasses in place within hollow cylindrical body 14 without scratching or otherwise damaging the glasses. Plurality of planar protrusions 20 further prevents slippage of the glasses. In an alternative embodiment, the plurality of planar protrusions 20 may be a plurality of fingers.

To remove the glasses from the present invention, the user applies sufficient force to pull the eyeglasses away from the grip of the plurality of planar protrusions 20. The user places the eyewear in an open configuration and resumes wearing same.

Figure 10:
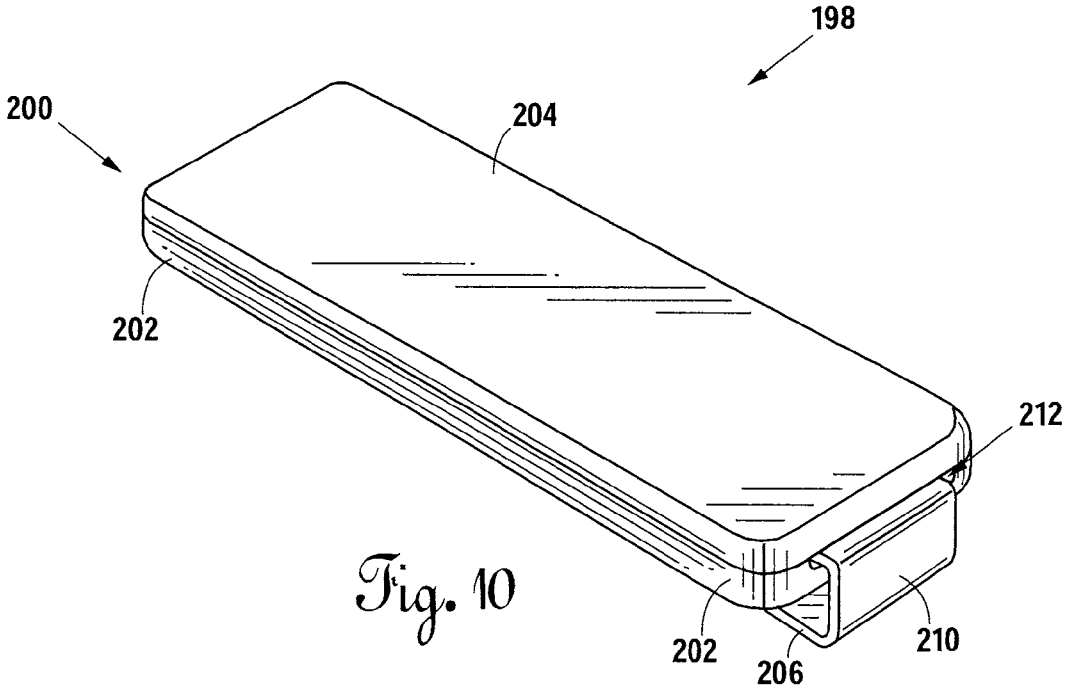
FIGS. 10-11 are isometric views of yet another embodiment of the invention.
Figure 11:
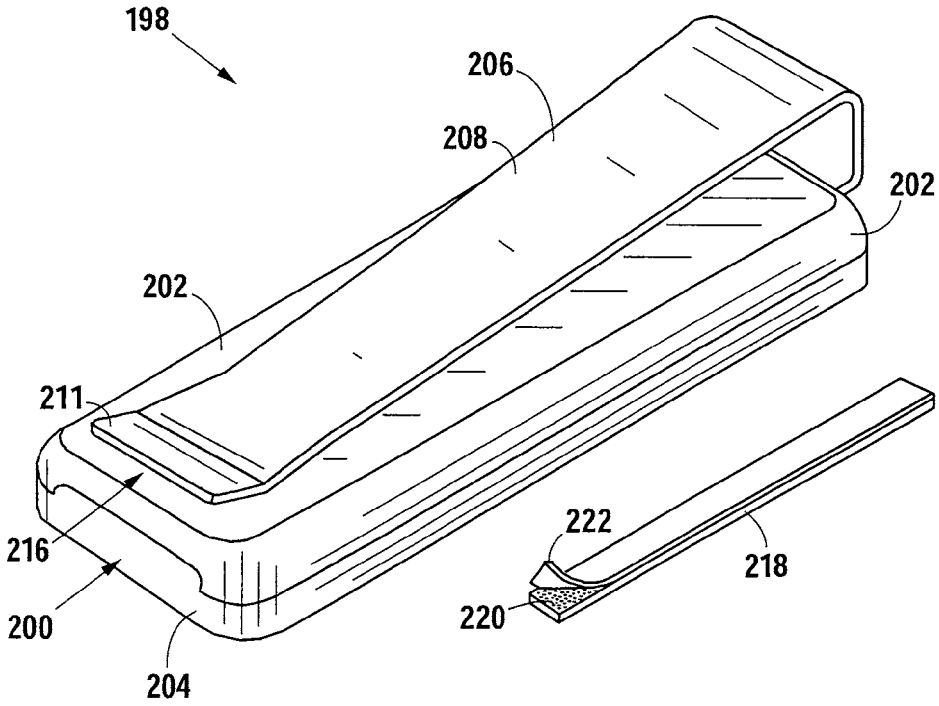

FIGS. 10-11 are isometric views, respectively, of an alternative embodiment 198 of the invention. This alternative embodiment 198 comprises a hollow body 200 formed of a thermoplastic elastomer first cover 202 fastenable to a second cover 204. A clip 206 having an arm 208 and an L-shaped bridge 210 is fixed to and extends from an open end 212 of the hollow body 200, with a part of the bridge 210 positioned within the hollow body 200. The end 211 of the arm 208 distal from the bridge 210 is angled away from the hollow body 200 to define a catch area 216 for an article of clothing or a portion thereof.

A metallic strip 218 is coated with an adhesive 220 on one side and may be decorated with initials, charms, logos, or similar markings. A removable protective cover 222 retains the adhesive 220 until the user is ready to adhere the metallic strip 218 to a pair of eyeglasses, as will be described infra with respect to FIG. 14.

Figure 12:
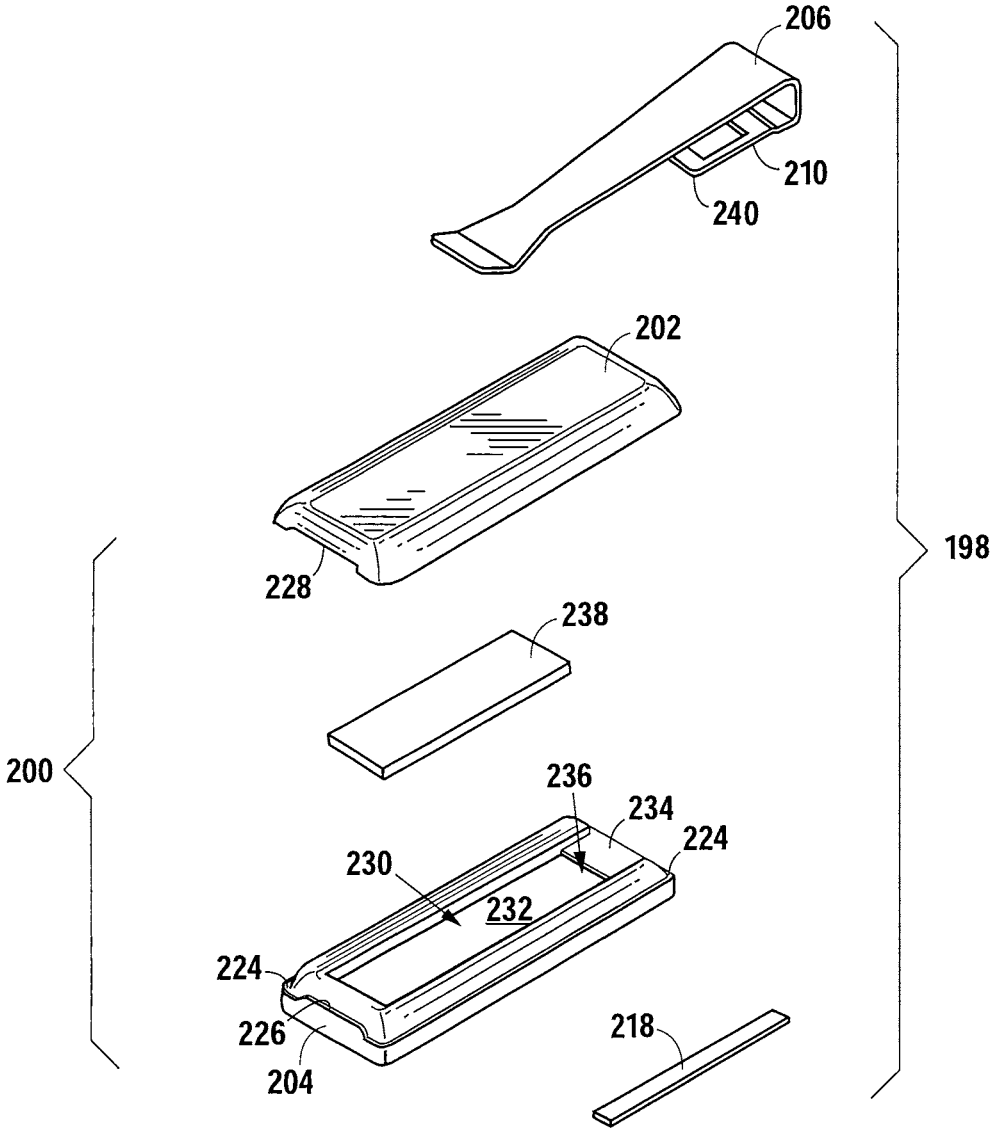
FIG. 12 is an assembly view of the embodiment shown in FIGS. 10-11.

FIG. 12 is an assembly view of the embodiment shown in FIGS. 10-11. The second cover 204 includes a lip 224 formed around its perimeter. A raised portion 226 of the lip 226 is fittable into a recessed portion 228 of the first cover 202 to help inhibit movement of the first cover 202 relative to the second cover 204. The second cover 204 includes a rectangular slot 230 to form an interior space defined by an inside surface 232 when the first cover 202 and second cover 204 are fastened to form the hollow body 200. A platform 234 is adjacent to one end 236 of the slot 230.

This embodiment includes a magnetic member 238 formed of neodymium, although the magnetic member 238 may be formed of other compositions sufficient to attract the metallic strip 218 through the hollow member 200. The shape and size of the magnetic member 238 generally corresponds to the shape and size of the slot 230 to minimize movement of the magnetic member 238 within the hollow body 200.

The first cover 202 is positioned over a free end 240 of the bridge 210 of the clip 206 and the slot 230 to form the hollow body 200 and retain the magnetic member 238 within the interior space. The free end 240 of the bridge 210 is welded to the second cover 204. In the preferred embodiment, the first cover 202 and second cover 204 are fixed together with an adhesive, although in alternative embodiments, the first and second covers 202, 204 may snap together or be joined using other conventional fastening techniques.

Figure 13B:
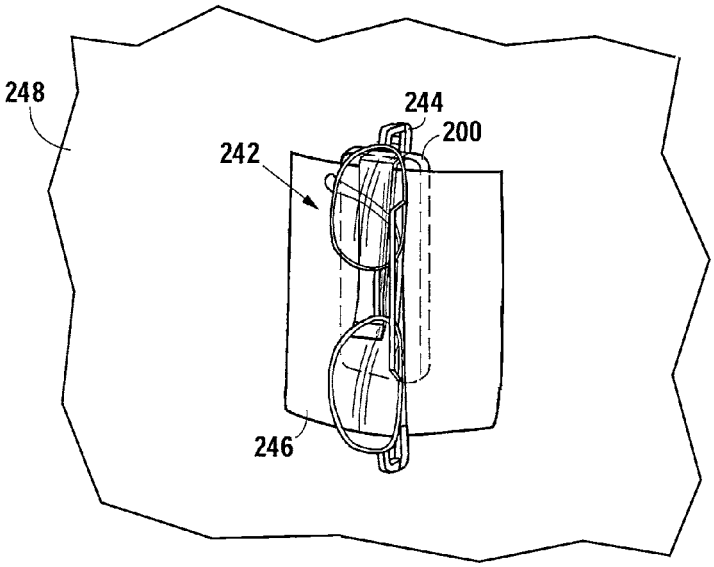
FIGS. 13A and 13B show the invention in use in a shirt pocket.
Figure 13A:
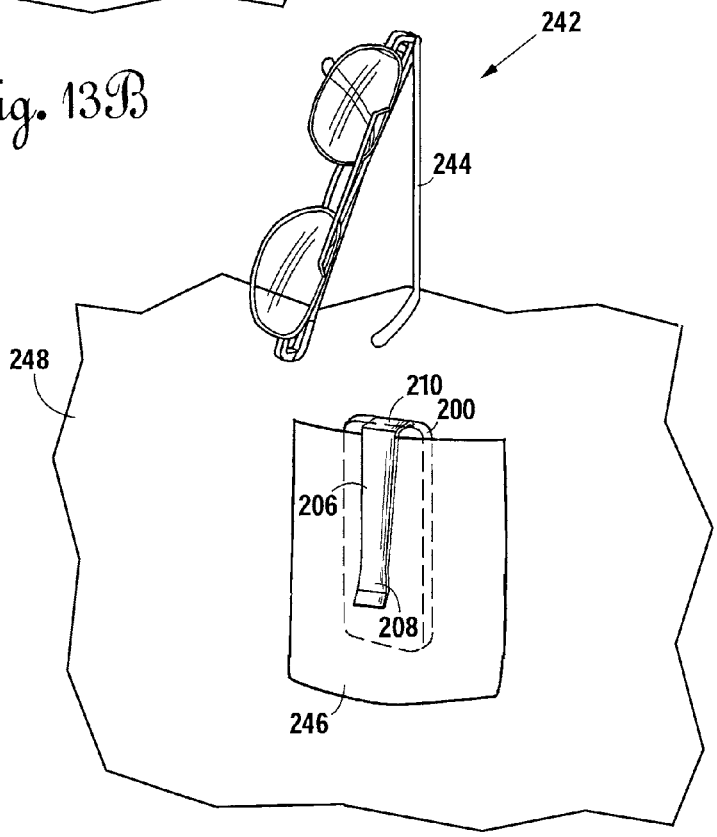

FIG. 13 shows this alternative embodiment in use with a pair of eyeglasses 242 having metallic arms 244. The clip 206 is fastened to a pocket 246 of a shirt 248 with the arm 208 positioned outside of the pocket 246 and the shirt 248 positioned in the groove formed by the arm 208, the bridge 210, and the hollow body 200. The hollow body 200 is positioned between the pocket 246 and the shirt 248. One arm 244 of the eyeglasses 242 is positioned in the pocket 246 adjacent to the hollow body 200. The magnetic member 238 (not shown) within the hollow body 200 magnetically attracts the metallic arm 244, causing the arm 244 to contact and be held against the hollow body 200. The lenses and other arm of the eyeglasses 242 are positioned outside of the pocket 246 when not used to hold the eyeglasses 242, any initials, charms, logos or other similar marking is prominently displayed on the clip 206.

Figure 14:
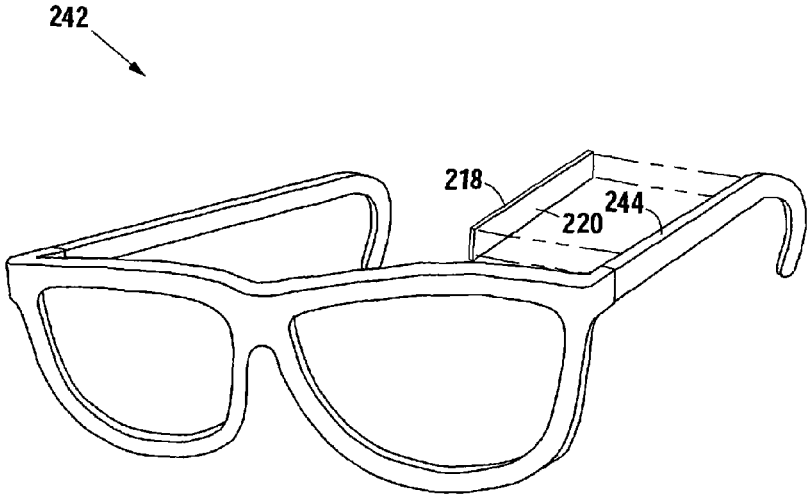
FIG. 14 shows the metallic strip of the alternative embodiment in use with a pair of non-metallic eyeglasses.

Referring to FIG. 14, this alternative embodiment 198 contemplates that not all eyeglasses frames may be metallic or attracted to a magnetic force. In these cases, the metallic strip 218 may be adhered to an arm 244 of the eyeglasses 242 by removing the protective cover 222 (FIG. 11) and firmly pressing the adhesive side of the metallic strip 218 to the outer surface of an arm 244 of the frame. Thereafter, the eyeglasses 242 may be used with the remainder of the system as described with reference to FIG. 13 supra.

The present invention is described above in terms of a preferred illustrative embodiment of a specifically described lightweight, unobtrusive holder for eyeglasses, as well as alternative embodiments of the present invention. Those skilled in the art will recognize that alternative constructions and implementations of such an apparatus can be used in carrying out the present invention. Other aspects, features, and advantages of the present invention may be obtained from a study of this disclosure and the drawings, along with the appended claims.

We claim:

1. An eyeglasses holder comprising:

a hollow body having open first end, a second end, and an interior space defined by an inside surface;

an arm having a first end and second arm end;

a bridge connecting the first arm end with the first end of said hollow body;

a funneling surface adjacent to the first end of the inside surface of the hollow body; and a plurality of protrusions extending from the inside surface of said hollow body, said protrusions extending from the funneling surface to the second of the hollow body.

* * * * *